United States Patent [19]

Bernstrom et al.

[11] Patent Number: 4,613,292

[45] Date of Patent: Sep. 23, 1986

[54] HYDRAULIC MOTOR HAVING FREE-WHEELING AND LOCKING MODES OF OPERATION

[75] Inventors: Marvin L. Bernstrom; Steven J. Zumbusch, both of Eden Prairie, Minn.

[73] Assignee: Eaton Corporation, Cleveland, Ohio

[21] Appl. No.: 697,596

[22] Filed: Feb. 1, 1985

[51] Int. Cl.[4] ..... F03C 2/08; F04C 2/10; B60K 17/356; F16D 41/00

[52] U.S. Cl. ..... 418/61 B; 418/69; 180/242; 192/4 A; 254/345

[58] Field of Search ..... 418/61 B, 69, 181; 180/132, 242; 192/4 A, 93 R; 254/345, 360

[56] References Cited

U.S. PATENT DOCUMENTS

| | | | |
|---|---|---|---|
| 2,821,171 | 1/1958 | Charlson | 418/61 B |
| 3,532,447 | 10/1970 | Charlson | 418/61 B |
| 3,853,435 | 12/1974 | Ogasahara et al. | 418/61 B |
| 4,435,130 | 3/1984 | Ohrberg et al. | 417/310 |
| 4,451,217 | 5/1984 | White | 418/69 |
| 4,493,404 | 1/1985 | Wenker | 192/4 A |
| 4,494,915 | 1/1985 | White, Jr. | 418/61 B |

OTHER PUBLICATIONS

*New Dimensions in Ball Bearings,* 1982, New Departure Hyatt Bearings, Sandusky, Ohio.

*Primary Examiner*—John J. Vrablik

*Attorney, Agent, or Firm*—C. H. Grace; L. J. Kasper

[57] ABSTRACT

A rotary fluid pressure device is provided of the type in which a valve spool (47) is axially movable within a spool bore (35). In the normal operating position of the valve spool (47), torque output is transmitted from the gerotor gear set (17) by means of a main drive shaft 53 through one spline connection (51, 49) then through a second spline connection (49, 75) to the output device. The valve spool (47) may be moved axially to a position in which the second spline connection (49, 54) is disengaged, and the device operates in a free-wheel mode. The valve spool (47) may also be moved axially to a position in which a set of teeth (71) on the valve spool engage a set of teeth (69) on the stationary housing, such that the device operates in a locked mode.

51 Claims, 11 Drawing Figures

FREE-WHEEL-REGULAR

FREE-WHEEL-SHORT-CIRCUIT

LOCKED-BLOCKED

HYDRAULIC MOTOR HAVING FREE-WHEELING AND LOCKING MODES OF OPERATION

BACKGROUND OF THE DISCLOSURE

The present invention relates to rotary fluid pressure devices, and more particularly, to such devices in which there is a main torque transmitting drive shaft coupled to the output shaft of the device.

Although the invention may be utilized in connection with various fluid pressure devices, it is especially adapted for use with low speed, high torque gerotor motors, and will be described in connection therewith.

Furthermore, although the present invention can be utilized with rotary fluid pressure devices having various types of valving, it is especially advantageous when used with devices having hollow, generally cylindrical spool valves wherein the valving action occurs at the interface of the valve spool and the adjacent housing surface.

Low speed, high torque gerotor motors have been in commercial use for many years and are especially suited for applications such as vehicle wheel drives, winch drives, and providing rotary torque to various other vehicle implements. Such motors have been commercially successful partially because the gerotor gear set is uniquely suited to provide the desired low speed, high torque output in a compact device which is relatively inexpensive.

However, in many of the applications for gerotor motors of the type noted above, it has been found desirable to be able occasionally to operate the motor in some mode other than its normal, operating mode. For example, if the motor is being used to provide torque to the drive wheels of a vehicle, when the vehicle is to be towed, it would be quite useful to be able to operate the motor in a free-wheeling mode. An attempt by the prior art to provide a motor capable of operating in a "free-wheeling" mode is illustrated by U.S. Pat. No. 4,435,130. Although the device disclosed therein is described as having a free-wheeling mode, the actual mode of operation is to establish a short-circuit flow path from the inlet port to the outlet port, across the commutating valve. Because the motor output shaft is still connected to the rotating element of the gerotor, the motor is not actually in a free-wheeling mode.

As another example of a desired mode, if the motor is being used to drive a winch, it is quite useful to be able to operate the motor in a locked mode of operation, to provide a positive load-holding capability. In order to achieve a locked mode of operation, it has been the normal practice to utilize some sort of mechanical brake in association with the output shaft of the gerotor motor. However, such an arrangement adds substantially to the overall size and expense of the motor package.

It is also desirable when two or more such motors are being used in a single circuit to be able to block flow through one of the motors, if the motors are in parallel, or to be able to short-circuit one of the motors, if the motors are in series. In the prior art, when such parallel and/or series operation has been desired, it has typically been achieved by means of the externally-plumbed flow control valve arrangement for controlling the flow of fluid to each of the motors. Achieving blocked flow of short-circuit flow in this manner can add substantially to the complication and expense of the flow control valve arrangement.

SUMMARY OF THE INVENTION

Accordingly, it is an object of the present invention to provide a rotary fluid pressure device of the type described herein which is capable of operating in modes other than its normal, operating mode when such other mode of operation is desired by the operator.

It is a related object of the present invention to provide such a device in which the operator is able to select any one of several such modes, alone or in combination.

It is another related object of the present invention to provide such a device which accomplishes the above-stated objects without adding substantial complication and expense to the device, or the associated control circuit.

The above and other objects of the present invention are accomplished by the provision of a rotary fluid pressure device of the type including housing means defining a first fluid port, a second fluid port, and a central bore. A gear set is associated with the housing means and includes a first toothed member and a second toothed member operatively associated with the first toothed member for relative movement therebetween. The teeth of the members interengage to define expanding and contracting fluid volume chambers during the relative movement, and one of the toothed members has rotational movement about its own axis. An output shaft means extends from the housing means and is rotatably supported thereby. A generally cylindrical coupling member is rotatably disposed within the central bore and a drive shaft means is operable to transmit the rotational movement of the toothed member having rotational movement about its own axis into rotational movement of the coupling member. The drive shaft means cooperates with the coupling member to define a first connection means. A valve means cooperates with the housing means to define a first fluid passage means communicating between the first fluid port and the expanding volume chambers and second fluid passage means communicating between the contracting volume chambers and the second fluid port. The output shaft means cooperates with the coupling member to define second connection means operable to transmit the rotational movement of said coupling member to said output shaft means with said coupling member in a normal, operating position.

The device is characterized by the first and second connection means being operable to permit axial movement of said coupling member relative to said drive shaft and said output shaft means. The coupling member is movable from said normal, operating position to another position. An actuation means is operable to effect axial movement of said coupling member between said normal, operating position and said another position to permit selective operation of said device in either a normal mode or another mode.

In accordance with more specific aspects of the present invention, the coupling member can be moved from its normal, operating position at the selection of the operator to a free-wheel position or a locked position, or a short-circuit postion, or a blocked flow position.

DESCRIPTION OF THE PREFERRED EMBODIMENTS

Figure 1:
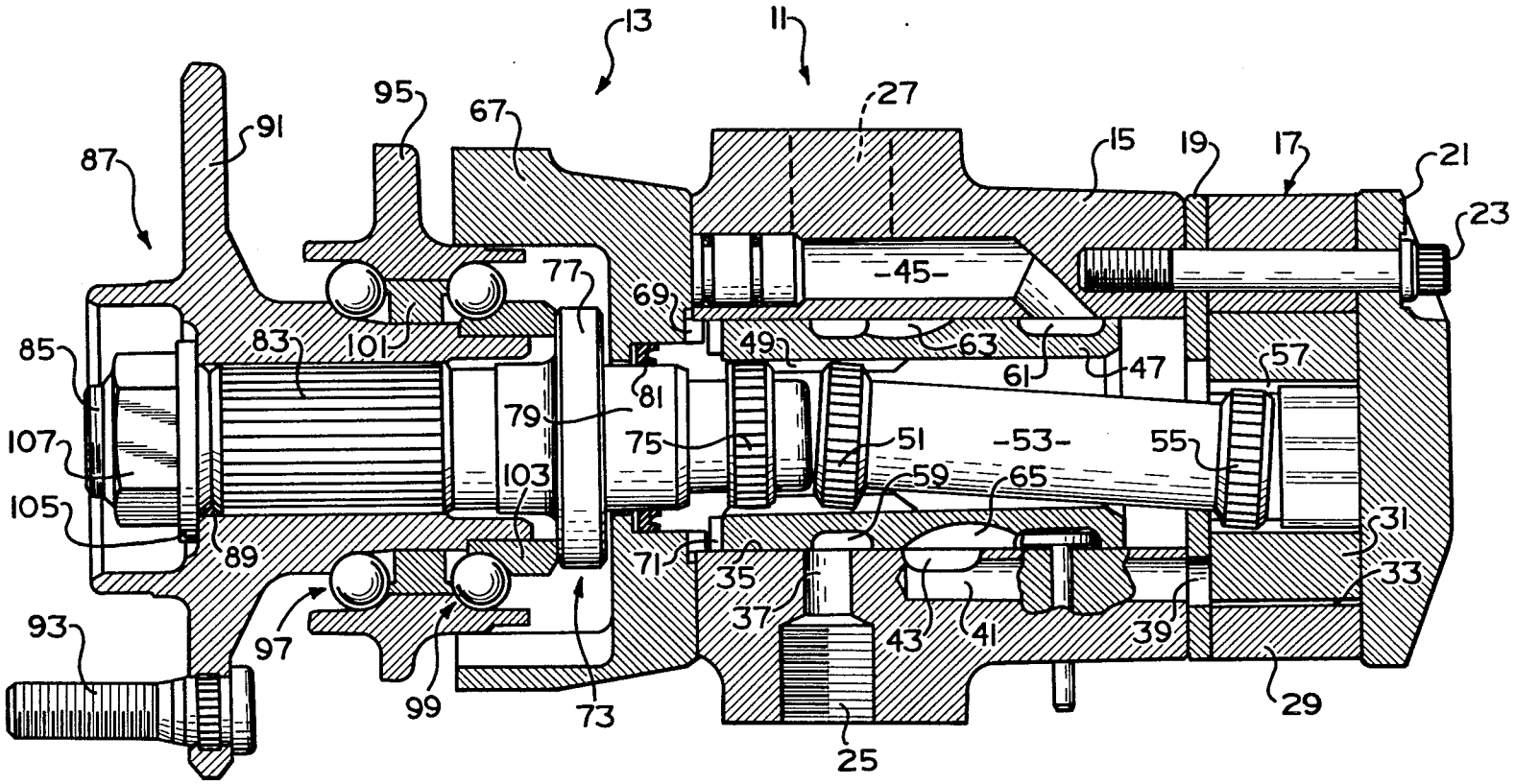
FIG. 1 is an axial cross-section of a fluid motor and spindle assembly made in accordance with the present invention, with the valve member in its normal, operating position.

Referring now to the drawings which are not intended to limit the invention, FIG. 1 is an axial cross-section of a fluid pressure motor and spindle assembly made in accordance with the present invention. The overall assembly includes a fluid motor portion, generally designated 11 which will be described first, and a spindle assembly, generally designated 13, which will be described subsequently.

The fluid motor portion 11 is of the general type illustrated and described in greater detail in U.S. Pat. Nos. 3,532,447; 3,606,598; and 4,362,479, all of which are assigned to the assignee of the present invention. The fluid motor portion 11 is generally cylindrical and comprises several distinct sections including a valve housing section 15, a fluid pressure actuated displacement mechanism 17 which, in the subject embodiment, is a gerotor gear set, and a port plate 19 disposed between the housing section 15 and the gerotor gear set 17. Disposed adjacent the gear set 17 is an end cap 21, and the housing section 15, port plate 19, gerotor set 17, and end cap 21 are held together in fluid sealing engagement by a plurality of bolts 23.

The valve housing section 15 includes a fluid inlet port 25 and a fluid outlet port 27, it being well understood in the art that the ports 25 and 27 may be reversed to reverse the direction of rotation of the rotary output. The gerotor gear set 17 includes an internally-toothed member 29 (ring), through which the bolts 23 pass, and an externally-toothed member 31 (star). The teeth of the ring 29 and star 31 interengage to define a plurality of expanding and contracting fluid volume chambers 33, as is well known in the art.

The valve housing 15 defines a valve bore 35 and a fluid passage 37 which provides continuous fluid communication between the inlet port 25 and the valve bore 35. In fluid communication with each of the volume chambers 33 is a port 39 defined by the port plate 19, and in fluid communication with each of the ports 39 is an axial passage 41 drilled in the valve housing 15. Each of the axial passages 41 communicates with the valve bore 35 through an elongated meter slot 43 which, typically, is milled during the machining of the valve housing 15. The valve housing 15 also defines a fluid passage 45 which provides communication between the fluid outlet port 27 and the valve bore 35.

Disposed within the valve bore 35 is a valve spool 47 which is axially shorter than the valve bore 35 for reasons which will be described subsequently. The valve spool 47 defines, toward its forward end (left end in FIG. 1) a set of straight, internal splines 49 which are in engagement with a set of external splines 51 formed about the forward end of a main drive shaft 53, commonly referred to as a "dogbone" shaft. The rearward end of the drive shaft 53 includes a set of external splines 55 which are in engagement with a set of straight, internal splines 57 defined by the star 31. Therefore, as is well known to those skilled in the art, as the star 31 orbits and rotates within the ring 29, in response to the flow of pressurized fluid through the volume chambers 33, the rotational component of the movement of the star 31 will be transmitted by the drive shaft 53 to the valve spool 47.

The valve spool 47 defines an annular groove 59 in continuous fluid communication with the fluid inlet port 25, through the fluid passage 37. Similarly, the valve spool 47 defines an annular groove 61 which is in continuous fluid communication with the fluid outlet port 27, through the passage 45. The valve spool 47 further defines a plurality of axial feed slots 63, and a plurality of axial feed slots 65. The slots 63 provide fluid communication between the annular groove 59 and certain of the meter slots 43, while the slots 65 provide fluid communication between the annular groove 61 and certain other of the meter slots 43. The resulting commutating valve action between the slots 63 and 65 and the slots 43 is well known in the art and will not be described further herein.

Referring still to FIG. 1, the spindle assembly 13 includes a spindle housing 67 which may be attached to the valve housing 15 by any suitable means, such as a plurality of bolts (not shown in FIG. 1). It is one important feature of the present invention that the spindle housing 67 defines a set of teeth 69, while the valve spool 47 defines an adjacent set of teeth 71 configured to engage the teeth 69 and lock the valve spool 47 to the spindle housing 67 as will be described in greater detail subsequently. It will be understood by those skilled in the art that the particular configuration of the teeth 69 and 71 is not important to the present invention, and any other suitable locking mechanism or engagement means could be utilized, as long as the rotatable valve spool can be locked relative to the fixed housing 67 (or 15).

Extending through a central opening in the spindle housing 67 is a connecting shaft 73 which, near its right end in FIG. 1, includes a set of external splines 75 in engagement with the internal splines 49 of the valve spool 47. The connecting shaft 73 also includes a larger diameter support portion 77, and adjacent the portion 77 is a shaft portion 79 which is closely spaced apart from the opening defined by the spindle housing 67. A lip seal 81 is received within a bore of the spindle housing 67 and seals against the outer periphery of the shaft portion 79, in order to keep the hydraulic fluid within the fluid motor portion 11. The connecting shaft 73 also includes a set of straight, external splines 83, and a forwardly-extending threaded portion 85.

Disposed about the forward end of the connecting shaft 73 is a generally annular spindle member 87, which defines a set of straight, internal splines 89 in engagement with the external splines 83 of the connecting shaft 73. The spindle member 87 also includes a generally circular flange portion 91, which is adapted to have a vehicle wheel (not shown in FIG. 1) attached thereto by means of a plurality of threaded studs 93, only one of which is shown in FIG. 1. Each of the studs 93 is pressed into an opening in the flange portion 91 in a manner which is well known in the art.

Disposed partially within the spindle housing 67 is a generally annular hub member 95 which, typically, is adapted to be attached to a vehicle frame (not shown in FIG. 1). The hub member 95 serves as the outer race for two sets of ball bearings 97 and 99, which are separated by a spacer member 101. The outer surface of the spindle member 87 serves as the inner race for the ball bearings 97, while a separate race member 103 serves as the inner race for the ball bearings 99. The right end of the race member 103 is seated against the adjacent surface of the support portion 77. A washer member 105 is disposed about the threaded portion 85 and engages a forward surface of the spindle member 87, while a nut 107 is threaded onto the threaded portion 85 and tightened to pull the connecting shaft 73 and support portion 77 and race member 103 forward, relative to the spindle member 87 and hub member 95, sufficiently to achieve the appropriate preload of the ball bearings 97 and 99.

Operation

The operation of fluid motors of the type illustrated in FIG. 1 is well known to those skilled in the art and will be described only briefly herein. When the fluid inlet port 25 is connected to a source of pressurized fluid, the fluid fills the passage 37, the annular groove 59, and each of the axial feed slots 63. Pressurized fluid flows through those meter slots 43 which are in communication through the respective axial passage 41 and port 39, with an expanding volume chamber 33. The presence of pressurized fluid results in orbital and rotational movement of the star 31 which, as described previously, results in the transmission of rotary torque from the star 31 to the valve spool 47 by means of the drive shaft 53. At the same time, low pressure fluid is being exhausted from each of the contracting volume chambers 33 and such fluid flows through the associated ports 39 and axial passages 41 to the respective meter slots 43. This exhaust fluid is then communicated to the feed slots 65 which are in instantaneous communication with those particular meter slots 43. The low pressure exhaust fluid then flows from the feed slots 65 to the annular groove 61, then through the fluid passage 45 to the outlet port 27, and to the next downstream device, which may be another fluid motor in series, or may be the system reservoir. Thus, it should be understood that, as used herein, the terms "low pressure" and "exhaust" fluid are relative terms, and the pressure of such fluid may be truly low pressure, flowing to the system reservoir, or may merely be low relative to the pressure of the fluid entering the inlet port 25, if there is another motor connected in series, downstream of the outlet port 27.

With the valve spool 47 in its normal, operating position as illustrated in FIG. 1, rotary torque which is transmitted from the star 31 to the valve spool 47 is then transmitted by means of the internal splines 49 and external splines 75 to the connecting shaft 73. In turn, the rotary torque is transmitted by the connecting shaft 73 through the external splines 83 and internal splines 89 to the splindle member 87, then to the vehicle wheel attached to the flange portion 91 or to whatever else constitutes the output device. It should be noted that in the normal operating position shown in FIG. 1, the teeth 69 and 71 are out of engagement with each other, thus permitting the transfer of rotary torque from the valve spool 47 to the connecting shaft 73. It should also be noted that the valve spool 47 may, in its broadest sense, be considered a coupling member, coupling the shaft 53 to the connecting shaft 73. Within the scope of the present invention, the "coupling" and commutating "valving" functions of the valve spool 47 could be performed by separate, independent members, as will be described in connection with the embodiment of FIG. 8.

Figure 2:
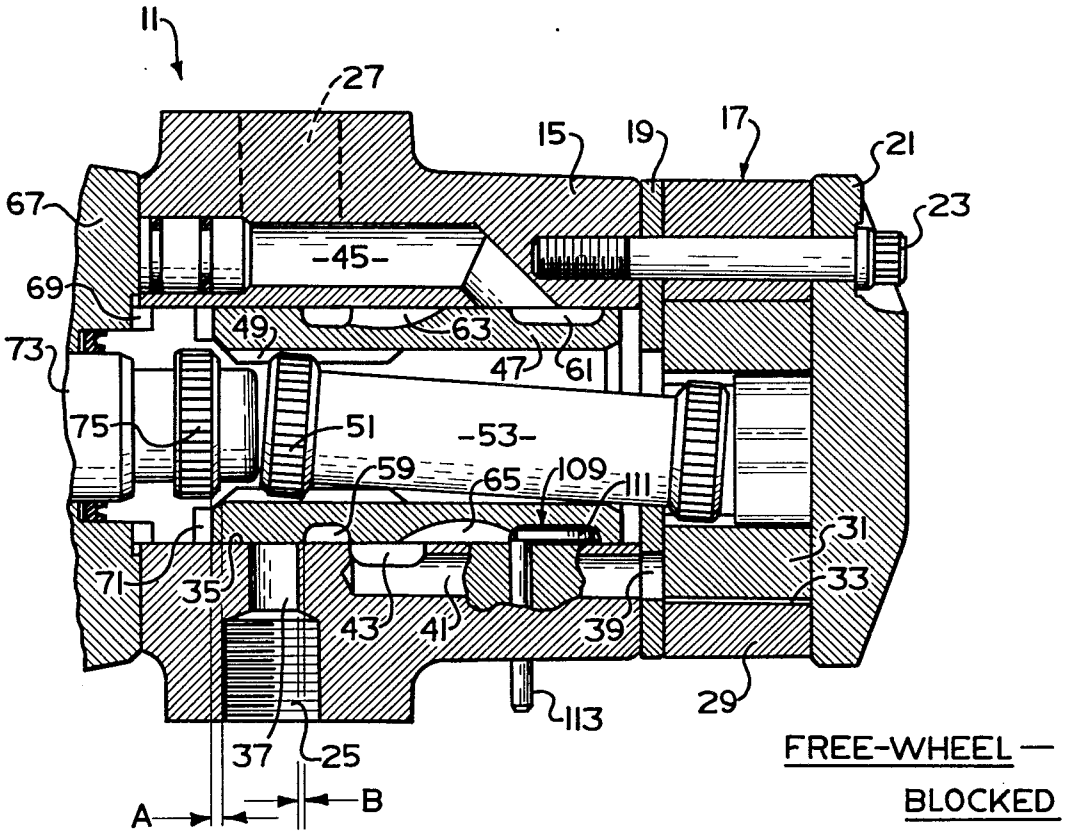
FIG. 2 is a fragmentary, axial cross-section, similar to FIG. 1, with the valve member in its blocked or free-wheel position.
Figure 2A:
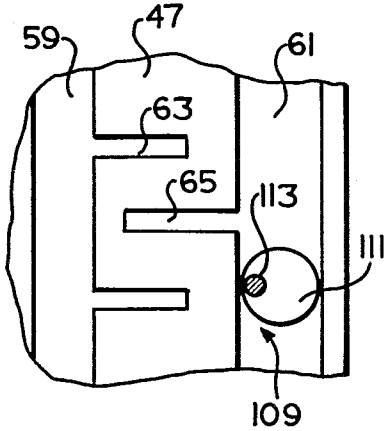
FIG. 2*a* is a fragmentary plan view of the cam means utilized with the present invention, in the position shown in FIG. 2, and on the same scale.

Referring now to FIG. 2, it may be seen that the valve spool 47 has been moved axially from its normal, operating position to a position which will be referred to initially as a "free-wheel" position of the valve spool 47. It should be understood that, for purposes of the present invention, the term "position" in reference to the valve spool 47 means its axial position within the bore 35. It is one feature of the present invention that, in order to achieve this axial movement of the valve spool 47, an actuation means is provided, which could be any form of actuation means which is capable of exerting sufficient force upon the valve spool 47 to achieve the necessary axial movement. It will be understood by those skilled in the art that the actuation means could be mechanical, electromechanical or hydraulic. In the subject embodiment, the actuation means comprises a cam means, generally designated 109 (see also FIG. 2*a*). The cam means 109 comprises a generally cylindrical, relatively thin cam member 111 which is disposed within the annular groove 61. Attached to the cam member 111, and disposed eccentrically relative thereto is an elongated actuating member 113 which, as shown in each of FIGS. 1 and 2, extends radially outwardly through a bore in the valve housing 15. The end of the actuating member 113 may be attached to any suitable rotary actuator (not shown herein) which is capable of rotating the cam member 111 and actuating member 113 sufficiently to achieve the desired axial movement of the valve spool 47.

Referring still to FIG. 2, it may be seen that with the valve spool 47 in the "free-wheel" position, the internal splines 49 of the valve spool 47 are no longer in engagement with the external splines 75 of the connecting shaft 73. Therefore, when the motor 11 is in the free-wheel mode of operation, it is possible to freely rotate the flange portion 91 without causing the motor portion 11 to act like a fluid pump, which could consume a substantial amount of input energy and could be undesirable for other reasons. For example, if the device of the invention comprises a wheel motor with the flange portion 91 attached to the vehicle drive wheels, the motor portion 11 can be shifted to the free-wheel mode and the vehicle can then be easily towed.

Referring still to FIG. 2, the axial position of the valve spool 47 may also be referred to as the "blocked" position. The term "blocked" refers to the fact that the fluid passage 37 and annular groove 59 are no longer in fluid communication, but instead, flow through the passage 37 is blocked by the outer cylindrical surface of the valve spool 47. Therefore, when the valve spool 47 is in the blocked position, and the motor portion 11 is operating in the free-wheel mode, there is no flow of fluid through the motor (i.e., between the inlet port 25 and outlet port 27).

In the subject embodiment of the invention, when the valve spool 47 is in the free-wheel, blocked position of FIG. 2, the internal splines 49 are disposed out of engagement with the external splines 75 by a distance A, while the annular groove 59 is out of communication with the passage 37 by a distance B. Because the distance B is less than the distance A, as the valve spool 47 is shifted from the free-wheel, blocked position of FIG. 2 toward its normal, operating position shown in FIG. 1, normal fluid communication through the motor will begin before engagement of the splines 49 and 75 occurs. As a result, there is torque transmitted to the drive shaft 53 to facilitate re-engagement of the splines 49 and 75.

Figure 9:
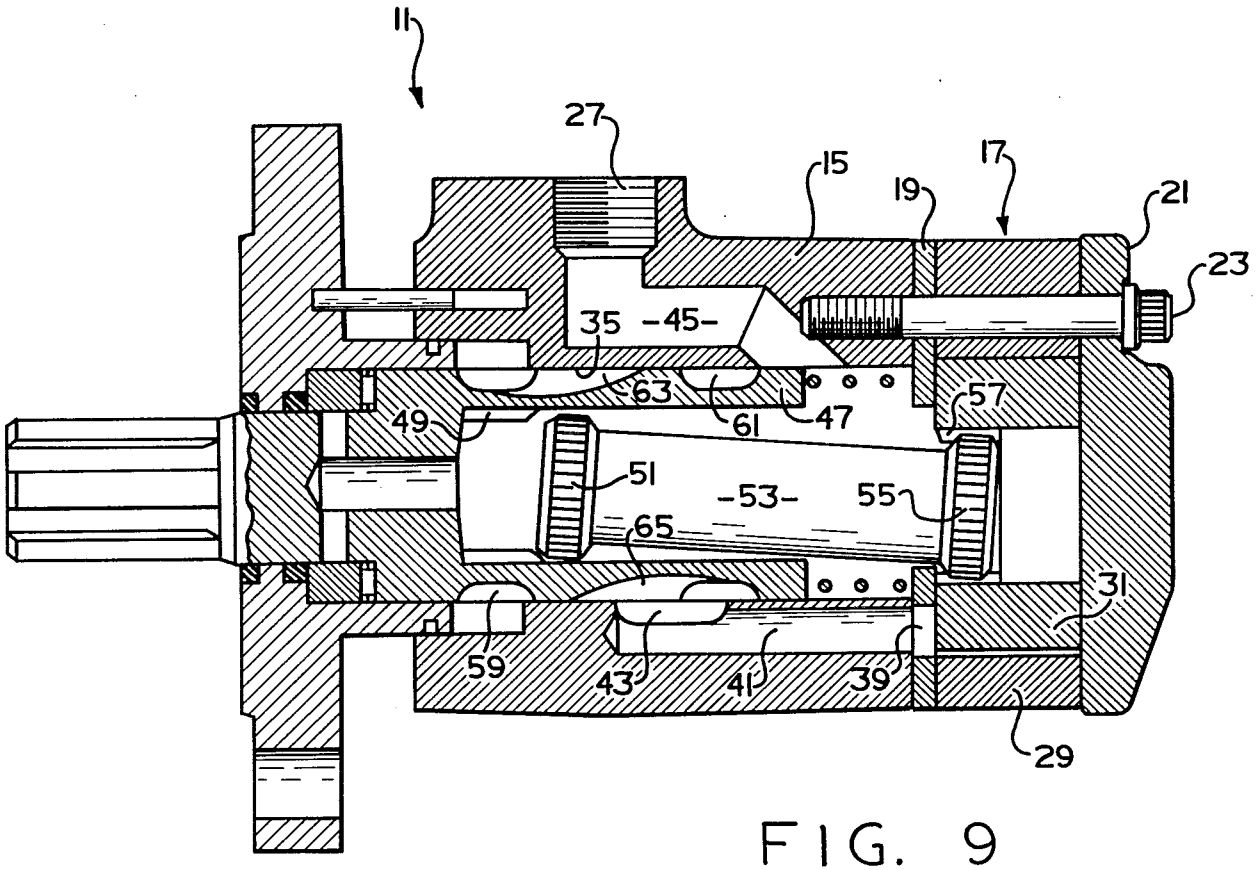
FIG. 9 is an axial cross-secion of a fluid motor which is in a free-wheel mode by means of disengagement of the forward spline connection.

If several motors made in accordance with this invention, which will be referred to as motors A and B, are connected in parallel, and the operator wishes to direct all available flow through the motor A, he can shift the valve spool 47 of the motor B to the blocked position, such that none of the system fluid will flow through the motor B and all will flow through the motor A. It should be apparent to those skilled in the art that, although the free-wheel mode of operation and the blocked position of the valve spool 47 are illustrated in conjunction with each other in FIG. 2, it is within the scope of the present invention to utilize either of these features alone, independent of the other, or in conjunction with other valving modes. Referring now to FIG. 9, there is illustrated an embodiment of the invention which does not include a spindle assembly 13, and in which operation in the free-wheel, blocked-flow mode is accomplished by moving the valve housing 15 and its associated elements to the right in FIG. 9, relative to the valve spool 47. The result of this relative movement is that the set of external splines 51 on the main drive shaft 53 becomes disengaged from the internal splines 49 which are disposed within the valve spool 47, such that orbital and rotational movement of the main drive shaft 53 will not rsult in rotation of the spool valve 47 and output.

Figure 3:
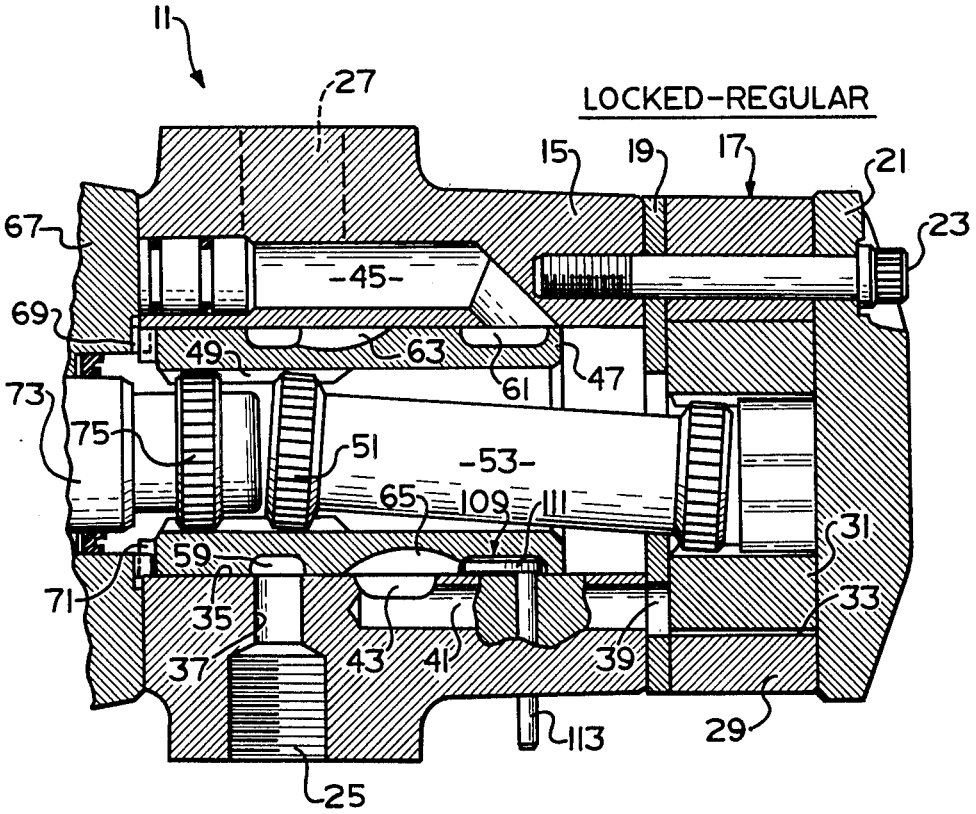
FIG. 3 is a fragmentary, axial cross-section, similar to FIG. 1 showing the valve spool in the locked position.

Referring now to FIG. 3, it may be seen that the valve spool 47 has been moved axially from its normal, operating position shown in FIG. 1 to a position which will be referred to initially as a "locked" position. In the locked mode of operation, the cam means 109 has been actuated to move the valve spool 47 to the left in FIG. 3 until the teeth 71 on the forward end of the valve spool 47 are in engagement with the teeth 69 defined by the spindle housing 67. With the valve spool 47 in the locked position shown in FIG. 3, the valve spool 47 is unable to turn relative to the housing (and relative to the vehicle frame). Therefore, when the motor portion 11 is operating in the locked mode, the connecting shaft 73 is unable to rotate relative to the housing, as is the flange portion 91 and the output device, such as the vehicle wheel. Thus, if the vehicle is to be left on a slope, the valve spool 47 may be shifted to the locked position, which will lock the vehicle wheels in the manner of an automotive parking brake. If the motor of the invention is being used to drive a lifting device such as a winch, the locked mode of operation may be used to provide positive load holding capability.

Referring still to FIG. 3, it should be noted that with the valve spool in the locked position, the fluid passage 37 and annular groove 59 are still in fluid communication with each other and thus, it is still possible to communicate pressurized fluid through the motor portion 11 in the "regular" manner, and the embodiment shown in FIG. 3 is identified as being in the "locked-regular" mode. An advantage of the locked-regular mode is that, when it is desired by the operator to shift the valve spool 47 from the locked position to the right to the normal operating position, it is desirable to have torque output immediately (i.e., as soon as the teeth 71 are disengaged from the teeth 69). With this arrangement, if the motor is driving a winch, the immediate torque output will prevent the load from dropping as the valve spool 47 is unlocked or, if the motor is driving vehicle wheels, this arrangement will prevent the vehicle from rolling down a hill.

Figure 4:
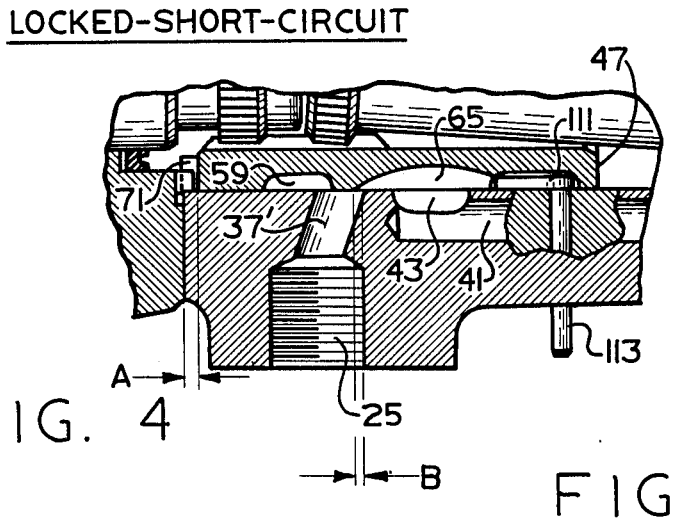
FIG. 4 is a fragmentary, axial cross-section, similar to FIG. 3 with the valve spool in the locked position, but illustrating an alternative embodiment whereby the valve member is also in a short-circuit position.
Figure 4A:
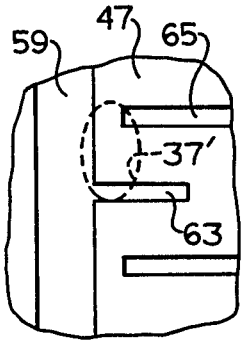
FIG. 4*a* is a fragmentary plan view illustrating the short-circuit position of FIG. 4, and on the same scale.

Referring now to FIGS. 4 and 4*a*, there is illustrated another embodiment of the invention in which, when the valve spool 47 is moved to the locked position, the motor portion 11 cannot still act as a motor, but instead, operates in a "short-circuit" mode. This short circuit mode is accomplished by having a fluid passage 37' communicating between the inlet port 25 and the valve bore 35. Preferably, the fluid passage 37' is oriented at an angle, as shown in FIG. 4, and also is oriented somewhat tangentially to the valve bore 35 such that the intersection of the passage 37' and the valve bore 35 provides an elongated, oval flow area as shown in FIG. 4*a*. In addition, it may be necessary in order to achieve the "short-circuit" mode to have the axial feed slots 65 be longer in the axial direction then they were in the embodiments of FIGS. 1, 2 and 3. Therefore, as may be seen in FIG. 4*a*, when the valve spool 47 is shifted to the locked-short circuit position, the axial feed slots 63 and 65 are cross-ported or short-circuited which, of course, is the same as cross-porting the inlet port 25 and outlet port 27.

In the subject embodiment of the invention, when the valve spool 47 is in the locked, short-circuit position, the teeth 69 and 71 are into engagement with each other over an axial distance A or, in other words, are a distance A from being in their rotation-permitting position. At the same time, the axial feed slots 65 are into fluid communication with the passage 37' by a distance B. Because the distance B is less than the distance A, when the valve spool 47 is shifted away from the locked, short-circuit position of FIG. 4 toward its normal, operating position, normal fluid communication through the motor will begin (slots 65 out of communication with passage 37') before disengagement of the teeth 69 and 71. As a result, there is torque transmitted to the drive shaft 53 to prevent a load from dropping as the valve spool 47 is unlocked.

The embodiment of FIGS. 4 and 4*a* is especially useful when several motors are connected in series, and the operator desires to discontinue operation of one of the motors, but wishes to continue operation of the other motors. With the valve spool 47 shifted to the locked-short circuit position, the output of the motor is locked, but fluid can flow freely through the motor, from the inlet port 25 to the outlet port 27 with only a relatively small pressure drop occurring.

Although the "locked" and "short-circuit" modes of operation have been illustrated in conjunction with each other in FIGS. 4 and 4*a*, it should again be understood by those skilled in the art that, within the scope of the invention, these operating modes may each be used alone, independent of the other as will now be described.

Figure 5:
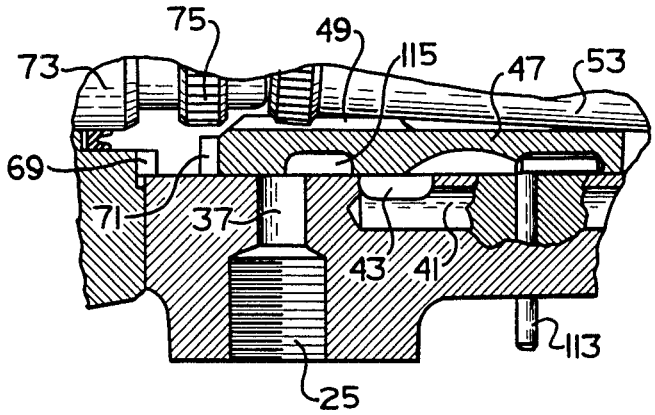
FIG. 5 is a fragmentary, axial cross-section, similar to FIG. 2, with the valve spool in a free-wheel position, but illustrating an alternative embodiment whereby the valve member provides regular valve action.

Referring now to FIG. 5, there is shown an alternative embodiment in which, when the valve spool 47 is shifted to the free-wheel position, pressurized fluid is communicated through the motor portion 11 in the "regular" manner, rather than flow being blocked as was the case in the free-wheel embodiment of FIG. 2. One advantage of combining the free-wheel and regular modes in a single embodiment is that pressurized fluid can be communicated through the motor in the regular manner, producing a rotary output of the drive shaft 53 and valve spool 47 to facilitate re-engagement of the internal splines 49 with the external splines 75 on the connecting shaft 73, when the valve spool 47 is eventually shifted from the free-wheel position back to its normal operating position. As may best be seen by comparing FIG. 5 with FIG. 2, the combination of the free-wheel mode and the regular valve operation may be accomplished by replacing the annular groove 59 of the FIG. 2 embodiment with an annular groove 115 which is located somewhat closer to the left end of the valve spool 47, and which has a slightly greater axial width.

Figure 6:
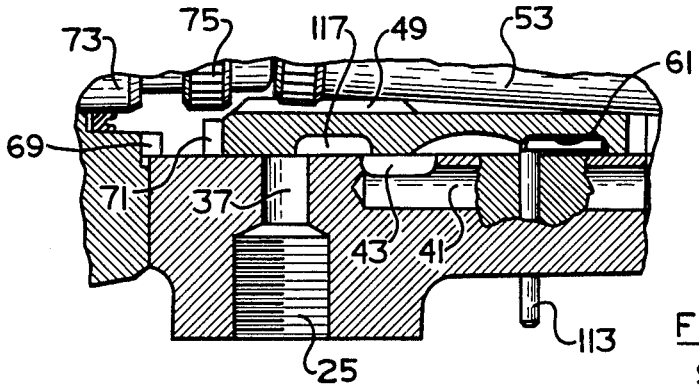
FIG. 6 is a fragmentary, axial cross-section, similar to FIG. 5, with the valve spool in a free-wheel position, but illustrating an alternative embodiment whereby the valve member at the same time provides short-circuit operation.

Referring now to FIG. 6, there is illustrated an alternative embodiment in which the free-wheel mode of operation is combined with a valve configuration which is capable of short-circuit operation. Such a combination may be quite useful if several of the motors are to be connected in series, as was described in connection with the FIG. 4 embodiment, but wherein it is desired that the motor which is being bypassed or short-circuited should operate in the free-wheel mode rather than in the locked mode. It may be seen by comparing FIG. 6 to FIG. 2 that this combination of the free-wheel mode and the short-circuit operation may be achieved by replacing the annular groove 59 of the FIG. 2 embodiment with an annular groove 117 which is located closer to the left end of the valve spool than is the groove 59, and has sufficient axial width such that the annular groove 117 provides fluid communication between the fluid passage 37 and all of the meter slots 43. At the same time, a number of the meter slots 43 are in communication with the outlet port 27 through the axial slots 65 and annular groove 61, such that there is a relatively small pressure drop through the motor, with no net force acting to turn the gerotor star 31.

Figure 7:
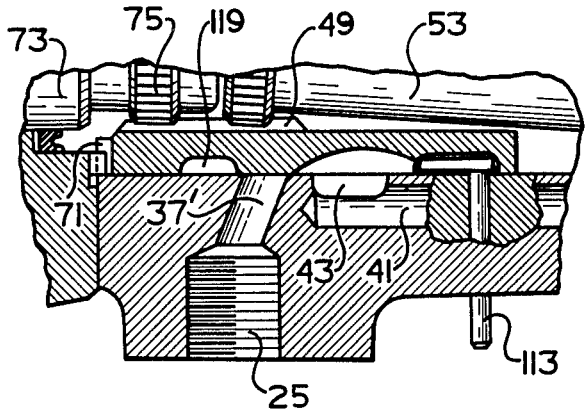
FIG. 7 is a fragmentary, axial cross-section, similar to FIG. 4, with the valve spool in the locked position, but illustrating an alternative embodiment whereby the valve member is also in a blocked position.

Referring now to FIG. 7, there is illustrated an alternative embodiment in which the motor operates in the locked mode, but with the valve spool 47 being configured to provide a blocked flow capability. Such an arrangement would be advantageous if several motors were connected in parallel, and the operator wished to lock one of the motors and have all of the flow directed to the other motor. As may best be seen by comparing FIG. 7 to FIG. 4, the combination of the locked mode with the blocked flow operation can be achieved simply by replacing the annular groove 59 of FIG. 4 with an annular groove 119 which is located the same distance from the left end of the valve spool 47, but which is sufficiently shorter axially than the annular groove 59 such that the annular groove 119 does not communicate with the fluid passage 37' when the valve spool 47 is in the locked position shown in FIG. 7. Thus, pressurized fluid in the inlet port 25 and in the fluid passage 37' is blocked from further communication by the surface of the valve spool 47.

Figure 8:
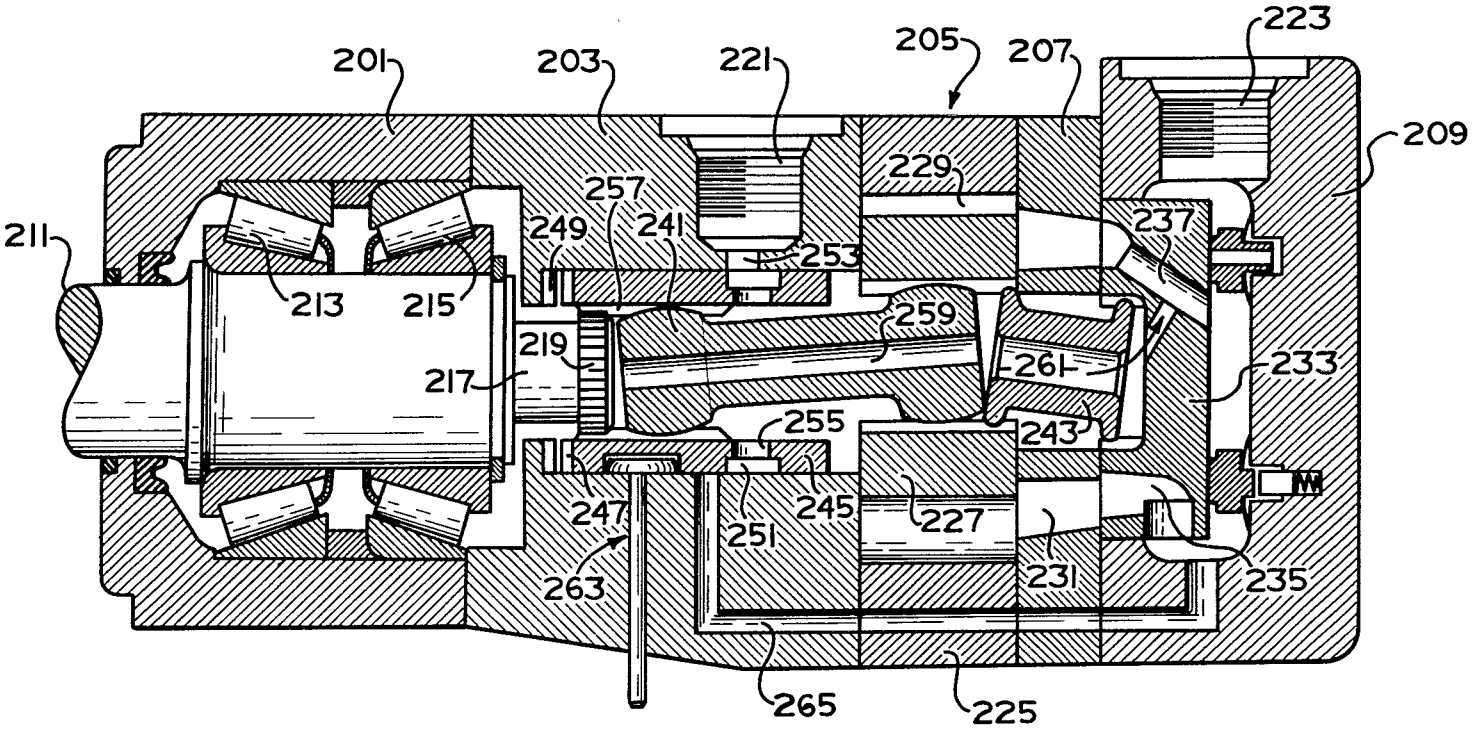
FIG. 8 is an axial cross-section of a fluid motor made in accordance with an alternative embodiment of the present invention in which a member other than the main commutating valve member is shifted axially to achieve the various operating modes.

Referring now to FIG. 8, there is illustrated an alternative embodiment of the present invention in which the "coupling" and "commutating valve" functions are performed by separate members, rather than both being performed by the spool valve 47 as in the embodiments of FIGS. 1 through 7. Another primary difference is that the motor in the FIG. 8 embodiment is a "disc valve" motor whereas the embodiments in FIGS. 1 through 7 are "spool valve" motors.

Many of the parts of the motors shown in FIG. 8 are well known and of the general type illustrated and described in U.S. Pat. Nos. 3,572,983 and 3,862,814, assigned to the assignee of the present invention. Certain aspects of the motor of FIG. 8 are known from FIG. 8 of U.S. Pat. No. 4,171,938, also assigned to the assignee of the present invention. Therefore, the motor of FIG. 8 will be described only briefly.

The motor of FIG. 8 comprises a plurality of sections, including a bearing housing 201, a coupling housing 203, a gerotor gear set 205, a port plate 207, and an end cap 209. The motor includes an output shaft generally designated 211, including a portion which is disposed within the bearing housing 201 and is rotatably supported therein by suitable bearing sets 213 and 215. The output shaft 211 includes a rearwardly extending (to the right in FIG. 8) shaft portion 217 which includes a set of straight, external splines 219.

The coupling housing 203 defines a fluid port 221, while the end cap 209 defines a fluid port 223. The gerotor gear set 205 includes an internally-toothed ring member 225, and an externally-toothed star member 227, the ring 225 and star 227 interengaging to define expanding and contracting fluid volume chambers 229. In fluid communication with the fluid chambers 229 are a plurality of fluid passages 231 defined by the port plate 207. Disposed within the end cap 209 is a rotary disc valve member 233 defining sets of fluid ports 235 and 237 which are in commutating fluid communication with the ports 231 in a manner well known in the art.

Disposed within the coupling housing 203 is a main drive shaft 241 which, at its right end in FIG. 8 is in splined engagement with the star 227. Also in splined engagement with the star 227 and the disc valve 233 is a valve drive shaft 243 in a manner, and for reasons which are well known in the art.

Also disposed within the coupling housing 203 is a generally annular, hollow coupling member 245 which, for purposes of the present invention, performs generally the same coupling function as does the valve spool 47 of FIGS. 1 through 7. However, as noted previously, in the FIG. 8 embodiment, the disc valve 233 performs the commutating valve function which in the embodiments of FIGS. 1 through 7 was also performed by the valve spool 47.

Adjacent the forward end of the coupling member 245 (left end in FIG. 8) is a set of teeth 247 which are operable to engage with a mating set of teeth 249 defined by the coupling housing 203. Thus, the coupling member 245 may be locked relative to the coupling housing 203 in generally the same manner as shown in FIGS. 3, 4 and 7.

The coupling member 245 defines an annular groove 251 which is in continuous fluid communication with the fluid port 221 by means of a passage 253. The annular groove 251 is in continuous fluid communication with the interior of the coupling member 245 by means of a plurality of openings 255. The position of the coupling member 245 shown in FIG. 8 is the normal operating position, corresponding to the FIG. 1 position of the earlier embodiment. In the normal operating position, rotary torque output of the star member 227 is transmitted by means of the main drive shaft 241 to a set of straight, internal splines 257, formed on the interior of the coupling member 245. In the normal operating position shown in FIG. 8, the splines 257 are in engagement with the external splines 219 of the output shaft 211, such that the torque output is transmitted to the output shaft 211.

It should be noted that either fluid port 221 or 223 can be the inlet port, with the other being the outlet port. It should also be noted that the drive shaft 241 defines an elongated central bore 259, while the valve drive shaft defines a central bore 261. Furthermore, the flow path of the fluid will be generally as illustrated and described in connection with FIG. 8 of U.S. Pat. No. 4,171,938, incorporated herein by reference. By way of only a brief explanation, the fluid flowing from the port 221, if it is the inlet (or toward port 221 if it is the outlet), will divide into two portions, with one portion flowing through the splines 257 then through bores 259 and 261, and the other portion flowing through the splines defined by the star 227. It should be noted that the particular flow path division just described is well suited for the embodiment of FIG. 8, but is not especially related to the present invention and will not be described in further detail.

The motor shown in FIG. 8 further includes a cam means 263 which is functionally identical to the cam means 109 in FIGS. 1 through 7. The coupling housing 203, the ring 225, the port plate 207, and the end cap 209 cooperate to define a fluid passage 265, the function of which will be described subsequently. If the cam means 263 is actuated to move the coupling member 245 to the right in FIG. 8, the internal splines 257 become disengaged from the external splines 219, and the motor then operates in its free-wheel mode. At the same time, the annular groove 251 is moved out of engagement with the passage 253, such that fluid communication to and from the fluid port 221 is blocked, thus corresponding to the operating mode shown in FIG. 2.

If the cam means 263 is actuated to move the coupling member 245 to the left in FIG. 8, such that the teeth 247 engage the teeth 249, the motor then operates in its locked mode. At the same time, the annular groove 251 would then be in fluid communication with the radially extending portion of the fluid passage 265, and at the same time, would still be in fluid communication with the port 221 through the fluid passage 253. Thus, the port 221 would be in open, relatively unrestricted fluid communication through the passage 265 with the fluid port 223. Thus, the coupling member 245 would be in a short-circuit position (corresponding to the operating mode illustrated in FIG. 4).

From a reading and understanding of the present specification, it may be seen that the invention provides a number of novel and useful operating modes which can be used in a number of different combinations. At the same time, these various operating modes are accomplished without substantially increasing the size, complexity, or expense of the motor. It is believed that various other modifications and alterations of the embodiment will become apparent to those skilled in the art, and it is intended that all such alterations and modifications are part of the invention, insofar as they come within the scope of the appended claims.

We claim:

1. A rotary fluid pressure device of the type including housing means defining a first fluid port, a second fluid port, and a valve bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical valve spool rotatably disposed within said valve bore; drive shaft means operable to transmit said rotational movement of said one of said toothed members into rotational movement of said valve spool, said drive shaft means cooperating with said valve spool to define a first connection means; said valve spool, in its normal, operating position, and said housing means cooperating to define first fluid passage means communicating between said first fluid port and said expanding volume chambers, and second fluid passage means communicating between said contracting volume chambers and said second fluid port; said output shaft means cooperating with said valve spool to define second connection means operable to transmit said rotational movement of said valve spool to said output shaft means with said valve spool in said normal, operating position; characterized by:

(a) said first connection means being operable to permit axial movement of said valve spool relative to said drive shaft means, and one of said first and second connection means being operable to permit axial movement of said valve spool from said normal, operating position to a free-wheel position in which said one of said first and second connection means is disengaged; and (b) actuation means operable to effect axial movement of said valve spool between said normal, operating position and said free-wheel position to achieve free-wheeling operating of said rotary fluid presssure device.

2. The rotary fluid pressure device as claimed in claim 1 characterized by said gear set comprising a gerotor gear set, said first toothed member comprising an internally-toothed member and said second toothed member comprising an externally-toothed member eccentrically disposed within said internally toothed member for relative orbital and rotational movement therebetween.

3. The rotary fluid pressure device as claimed in claim 1 characterized by said output shaft means comprising a spindle assembly fixedly attached to said housing means, a spindle member adapted to be attached to an output device, and a connecting shaft cooperating with said valve spool to define said second connection means and being operable to transmit said rotational movement of said valve spool to said spindle member and said output device.

4. The rotary fluid pressure device as claimed in claim 3 characterized by said second connection means comprising said valve spool defining a set of straight, internal splines and said connecting shaft defining a set of external splines in engagement with said internal splines, said spindle assembly including a spindle housing fixed to said housing means and at least partially surrounding said connecting shaft and said spindle member.

5. The rotary fluid pressure device as claimed in claim 4 characterized by said spindle assembly further comprising bearing means disposed radially between said spindle housing and said spindle member.

6. The rotary fluid pressure device as claimed in claim 1 characterized by said valve spool comprising a generally hollow member, said first connection means comprising said valve spool defining a set of straight, internal splines and said drive shaft means defining a set of external splines in engagement with said internal splines.

7. The rotary fluid pressure device as claimed in claim 6 characterized by said second connection means comprising said set of straight, internal splines and said output shaft means defining a set of external splines in engagement with said internal splines.

8. The rotary fluid pressure device as claimed in claim 1 characterized by said first fluid passage means comprising said valve spool defining a first annular groove on the outer periphery thereof, in continuous fluid communication with said first fluid port when said valve spool is in said normal, operating position, said first annular groove being blocked from substantial fluid communication with said first fluid port when said valve spool is in said free-wheel position.

9. The rotary fluid pressure device as claimed in claim 1 characterized by said first connection means remaining engaged when said valve spool is in said free-wheel position, while said second connection means is disengaged when said valve spool is in said free-wheeel position.

10. The rotary fluid pressure device as claimed in claim 1 characterized by said actuation means comprising cam means, said valve spool defining a cam surface and said cam means further including a cam member disposed in engagement with said cam surface, said cam member being movable between a first position in which said valve spool is in said normal, operating position, and a second position, in which said valve spool is in said free-wheel position.

11. A rotary fluid pressure device of the type including housing means defining a first fluid port, a second fluid port, and a valve bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical valve spool rotatably disposed within said valve bore; drive shaft means operable to transmit said rotational movement of said one of said toothed members into rotational movement of said valve spool, said drive shaft means cooperating with said valve spool to define a first connection means; said valve spool, in its normal, operating position, and said housing means cooperating to define first fluid passage means communicating between said first fluid port and said expanding volume chambers, and second fluid passage means communicating between said contracting volume chambers and said second fluid port; said output shaft means cooperating with said valve spool to define second connection means operable to transmit said rotational movement of said valve spool to said output shaft means; characterized by:

(a) said first and second connection means being operable to permit axial movement of said valve spool relative to said drive shaft means and said output shaft means, said valve spool being movable from said normal operating position to a locked position;

(b) said housing means and said valve spool cooperating to define engagement means operable, when said valve spool is in said locked position to prevent rotation of said valve spool relative to said housing means, said engagement means being operable, when said valve spool is in said normal, operating position, to permit rotation of said valve spool, relative to said housing means; and (c) actuation means operable to effect axial movement of said valve spool between said normal, operating position and said locked position to achieve locked operation of said rotary fluid pressure device.

12. The rotary fluid pressure device as claimed in claim 11 characterized by said gear set comprising a gerotor gear set, said first toothed member comprising an internally-toothed member and said second toothed member comprising an externally-toothed member eccentrically disposed within said internally toothed member for relative orbital and rotational movement therebetween.

13. The rotary fluid pressure device as claimed in claim 11 characterized by said output shaft means comprising a spindle assembly fixedly attached to said housing means, a spindle member adapted to be attached to an output device, and a connecting shaft cooperating with said valve spool to define said second connection means and being operable to transmit said rotational movement of said valve spool to said spindle member and said output device.

14. The rotary fluid pressure device as claimed in claim 13 characterized by said second connection means comprising said valve spool defining a set of straight, internal splines and said connecting shaft defining a set of external splines in engagement with said internal splines, said spindle assembly including a spindle housing fixed to said housing means and at least partially surrounding said connecting shaft and said spindle member.

15. The rotary fluid pressure device as claimed in claim 14 characterized by said spindle assembly further comprising bearing means disposed radially between said spindle housing and said spindle member.

16. The rotary fluid pressure device as claimed in claim 11 characterized by said valve spool comprising a generally hollow member, said first connection means comprising said valve spool defining a set of straight, internal splines and said drive shaft means defining a set of external splines in engagement with said internal splines.

17. The rotary fluid pressure device as claimed in claim 16 characterized by said second connection means comprising said set of straight, internal splines and said output shaft means defining a set of external splines in engagement with said internal splines.

18. The rotary fluid pressure device as claimed in claim 11 characterized by said first fluid passage means comprising said valve spool defining a first annular groove on the outer periphery thereof, in continuous fluid communication with said first fluid port when said valve spool is in said normal, operating position, and a second annular groove on the outer periphery of said valve spool, in continuous fluid communication with said second fluid port when said valve spool is in said normal, operating position, said first and second annular grooves and said first and second fluid ports being in generally continuous fluid communication with each other when said valve spool is in said locked position.

19. The rotary fluid pressure device as claimed in claim 11 characterized by said first fluid port being in fluid communication with said second fluid port by means of said first fluid passage means, said expanding volume chambers, said contracting volume chambers and said second fluid passage means when said valve spool is in said locked position, in substantially the same manner as said first fluid port communicates with said second fluid port when said valve spool is in said normal, operating position.

20. The rotary fluid pressure device as claimed in claim 11 characterized by said first and second connection means remaining engaged when said valve spool is in said locked position.

21. The rotary fluid pressure device as claimed in claim 11 characterized by said actuation means comprising cam means, said valve spool defining a cam surface and said cam means further including a cam member disposed in engagement with said cam surface, said cam member being movable between a first position in which said valve spool is in said normal, operating position, and a second position, in which said valve spool is in said locked position.

22. A rotary fluid pressure device of the type including housing means defining a first fluid port, a second fluid port, and a valve bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical valve spool rotatably disposed within said valve bore; drive shaft means operable to transmit said rotational movement of said one of said toothed members into rotational movement of said valve spool, said drive shaft means cooperating with said valve spool to define a first connection means; said valve spool defining first and second annular grooves on the outer periphery thereof, said first annular groove being in continuous fluid communication with said first fluid port, and said second annular groove being in continuous fluid communication with said second fluid port when said valve spool is in its normal, operating position, said valve spool and said housing means cooperating to define first fluid passage means communicating between said first annular groove and said expanding volume chambers, and second fluid passage means communicating between said contracting volume chambers and said second annular groove; said output shaft means cooperating with said valve spool to define second connection means operable to transmit said rotational movement of said valve spool to said output shaft means; characterized by:

(a) said first and second connection means being operable to permit axial movement of said valve spool relative to said drive shaft means and said output shaft means, said valve spool being axially movable between said normal, operating position and a short-circuit position in which said first and second fluid ports and said first and second annular grooves are in fluid communication with each other, bypassing said expanding and contracting volume chambers, when said valve spool is in said short-circuit position; and (b) actuation means operable to effect axial movement of said valve spool between said normal, operating position and said short-circuit position to achieve short-circuit operation of said rotary fluid pressure device.

23. The rotary fluid pressure device as claimed in claim 22 characterized by said gear set comprising a gerotor gear set, said first toothed member comprising an internally-toothed member and said second toothed member comprising an externally-toothed member eccentrically disposed within said internally toothed member for relative orbital and rotational movement therebetween.

24. The rotary fluid pressure device as claimed in claim 22 characterized by said valve spool comprising a generally hollow member, said first connection means comprising said valve spool defining a set of straight, internal splines and said drive shaft means defining a set of external splines in engagement with said internal splines.

25. The rotary fluid pressure device as claimed in claim 24 characterized by said second connection means comprising said set of straight, internal splines and said output shaft means defining a set of external splines in engagement with said internal splines.

26. The rotary fluid pressure device as claimed in claim 22 characterized by said actuation means comprising cam means, said valve spool defining a cam surface and said cam means further including a cam member disposed in engagement with said cam surface, said cam member being movable between a first position in which said valve spool is in said normal, operating position, and a second position, in which said valve spool is in said short-circuit position.

27. A rotary fluid pressure device of the type including housing means defining a first fluid port, a second fluid port, and a valve bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical valve spool rotatably disposed within said valve bore; drive shaft means operable to transmit said rotational movement of said one of said toothed members into rotational movement of said valve spool, said drive shaft means cooperating with said valve spool to define a first connection means; said valve spool defining first and second annular grooves on the outer periphery thereof, said first annular groove being in continuous fluid communication with said first fluid port, and said second annular groove being in continuous fluid communication with said second fluid port when said valve spool is in its normal, operating position, said valve spool and said housing means cooperating to define first fluid passage means communicating between said first annular groove and said expanding volume chambers, and second fluid passage means communicating between said contracting volume chambers and said second annular groove; said output shaft means cooperating with said valve spool to define second connection means operable to transmit said rotational movement of said valve spool to said output shaft means; characterized by:

(a) said first and second connection means being operable to permit axial movement of said valve spool relative to said drive shaft means and said output shaft means, said valve spool being movable from said normal, operating position to a blocked position in which one of said first and second fluid ports is blocked from substantial communication with the respective one of said first and second annular grooves; and (b) actuation means operable to effect axial movement of said valve spool between said normal, operating position and said blocked position to achieve blocked flow operation of said rotary fluid pressure device.

28. The rotary fluid pressure device as claimed in claim 27 characterized by said gear set comprising a gerotor gear set, said first toothed member comprising an internally-toothed member and said second toothed member comprising an externally-toothed member eccentrically disposed within said internally toothed member for relative orbital and rotational movement therebetween.

29. The rotary fluid pressure device as claimed in claim 27 characterized by said valve spool comprising a generally hollow member, said first connection means comprising said valve spool defining a set of straight, internal splines and said drive shaft means defining a set of external splines in engagement with said internal splines.

30. The rotary fluid pressure device as claimed in claim 29 characterized by said second connection means comprising said set of straight, internal splines and said output shaft means defining a set of external splines in engagement with said internal splines.

31. The rotary fluid pressure device as claimed in claim 27 characterized by said first connection means remaining engaged when said valve spool is in said blocked position, while said second connection means is disengaged when said valve spool is in said blocked position.

32. The rotary fluid pressure device as claimed in claim 27 characterized by said actuation means comprising cam means, said valve spool defining a cam surface and said cam means further including a cam member disposed in engagement with said cam surface, said cam member being movable between a first position in which said valve spool is in said normal, operating position, and a second position, in which said valve spool is in said blocked position.

33. A rotary fluid pressure device of the type including housing means defining a first fluid port, a second fluid port, and a valve bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical valve spool rotatably disposed within said valve bore; drive shaft means operable to transmit said rotational movement of said one of said toothed members into rotational movement of said valve spool, said drive shaft means cooperating with said valve spool to define a first connection means; said valve spool, in its normal, operating position, and said housing means cooperating to define first fluid passage means communicating between said first fluid port and said expanding volume chambers, and second fluid passage means communicating between said contracting volume chambers and said second fluid port; said output shaft means cooperating with said valve spool to define second connection means operable to transmit said rotational movement of said valve spool to said output shaft means with said valve spool in said normal, operating position; characterized by:

(a) said first and second connection means being operable to permit axial movement of said valve spool relative to said drive shaft means and said output shaft means, said valve spool being movable from said normal, operating position to another position;

(b) actuation means operable to effect axial movement of said valve spool between said normal, operating position and said another position, said actuation means comprising cam means, said valve spool defining a cam surface and said cam means further including a cam member disposed in engagement with said cam surface, said cam member being movable between a first position in which said valve spool is in said normal operating position, and a second position in which said valve spool is in said another position.

34. The rotary fluid pressure device as claimed in claim 33 characterized by said valve spool defining at least one annular groove at the outer periphery thereof, in continuous fluid communication with one of said first and second fluid ports when said valve spool is in said normal, operating position, said annular groove comprising said cam surface.

35. The rotary fluid pressure device as claimed in claim 34 characterized by said cam member comprising a generally cylindrical, relatively thin member defining an axis of rotation, disposed within said annular groove, and including an actuating member extending through said housing means and supported thereby, and disposed eccentrically relative to said axis of rotation of said cam member, whereby rotation of said actuating member results in eccentric movement of said cam member and axial movement of said valve spool.

36. A rotary fluid pressure device of the type including housing means defining a first fluid port, a second fluid port, and a central bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and being rotatably supported thereby; a generally cylindrical coupling member rotatably disposed within said central bore; drive shaft means operable to transmit said rotational movement of said one of said toothed members into rotational movement of said coupling member to define a first connection means; valve means cooperating with said housing means to define first fluid passage means communicating between said first fluid port and said expanding volume chambers, and second fluid passage means communicating between said contracting volume chambers and said second fluid port; said output shaft means cooperating with said coupling member to define second connection means operable to transmit said rotational movement of said coupling member to said output shaft means with said coupling member in a normal, operating position; characterized by:

(a) said first and second connection means being operable to permit axial movement of said coupling member relative to said drive shaft means and said output shaft means, said coupling member being movable from said normal, operating position to another mode in another position;

(b) actuation means operable to effect axial movement of said coupling member between said normal, operating positon and said another position to permit selective operation of said device in a normal mode and said another mode.

37. The rotary fluid pressure device as claimed in claim 36 characterized by said gear set comprising a gerotor gear set, said first toothed member comprising an internally-toothed member and said second toothed member comprising an externally-toothed member eccentrically disposed within said internally-toothed member for relative orbital and rotational movement therebetween.

38. The rotary fluid pressure device as claimed in claim 36 characterized by said output shaft means comprising a spindle assembly fixedly attached to said housing means, a spindle member adapted to be attached to an output device, and a connecting shaft cooperating with said coupling member to define said second connection means and being operable to transmit said rotational movement of said coupling member to said spindle member and said output device.

39. The rotary fluid pressure device as claimed in claim 38 characterized by said second connection means comprising said coupling member defining a set of straight, internal splines and said connecting shaft defining a set of external splines in engagement with said internal splines, said spindle assembly including a spindle housing fixed to said housing means and at least partially surrounding said connecting shaft and said spindle member.

40. The rotary fluid pressure device as claimed in claim 36 characterized by said coupling member comprising a generally hollow member, said first connection means comprising said coupling member defining a set of straight, internal splines and said drive shaft means definig a set of external splines in engagement with said internal splines.

41. The rotary fluid pressure device as claimed in claim 40 characterized by said second connection means comprising said set of straight, internal splines and said output shaft means defining a set of external splines in engagement with said internal splines.

42. The rotary fluid pressure device as claimed in claim 36 characterized by said actuation means comprising cam means, said coupling member defining a cam surface and said cam means further including a cam member disposed in engagement with said cam surface, said cam member being movable between a first position in which said coupling member is in said normal, operating position, and a second position, in which said coupling member is in said another position.

43. The rotary fluid pressure device as claimed in claim 36 characterized by said second connection means being operable to permit axial movement of said coupling member to a free-wheel position in which said second connection means is disengaged, said actuation means being operable to effect axial movement of said coupling member to said free-wheel position to achieve free-wheeling operation of said rotary fluid pressure device.

44. The rotary fluid pressure device as claimed in claim 43 characterized by said coupling member comprising a generally hollow member, said first connection means comprising said coupling member defining a set of straight, internal splines and said drive shaft means defining a set of external splines in engagement with said internal splines, said second connection means comprising said internal splines and said output shaft means defining a set of external splines in engagement with said internal splines.

45. The rotary fluid pressure device as claimed in claim 36 characterized by said coupling member being movable from said normal, operating position to a locked position, said housing means and said coupling member cooperating to define engagement means operable, when said coupling member is in said locked position to prevent rotation of said coupling member relative to said housing means, said engagement means being operable, when said coupling member is in said normal, operating position, to permit rotation of said coupling member, relative to said housing means; said actuation means being operable to effect axial movement of said coupling member to said locked position to achieve locked operation of said rotary fluid pressure device.

46. The rotary fluid pressure device as claimed in claim 45 characterized by said second connection means being operable to permit axial movement of said coupling member to a free-wheel position in which said second connection means is disengaged, said actuation means being operable to effect axial movement of said coupling member to said free-wheel position to achieve free-wheeling operation of said rotary fluid pressure device.

47. The rotary fluid pressure device as claimed in claim 36 characterized by said coupling member being axially movable to a short-circuit position in which said first and second fluid ports and said first and second fluid passage means are put in fluid communication with each other, bypassing said expanding and contracting volume chambers, said actuation means being operable to effect axial movement of said coupling member to said short-circuit position to achieve short-circuit operation of said rotary fluid pressure device.

48. The rotary fluid pressure device as claimed in claim 36 characterized by said coupling member being axially movable to a blocked position in which one of said first and second fluid ports is blocked from substantial fluid communication with the respective one of said first and second fluid passage means, said actuation means being operable to effect axial movement of said coupling member to said blocked position to achieve blocked flow operation of said rotary fluid pressure device.

49. The rotary fluid pressure device as claimed in claim 48 characterized by said first connection means remaining engaged when said coupling member is in said blocked position, while said second connection means is disengaged when said coupling member is in said blocked position.

50. The rotary fluid pressure device as claimed in claim 8 characterized by one of said first and second connection means being a distance A out of engagement, and said first annular groove being a distance B out of fluid communication with said first fluid port, when said valve spool is in said free-wheel position, the distance B being less than the distance A, whereby said annular groove begins to communicate with said first fluid port before said one of said first and second connection means becomes engaged as said valve spool is moved from said free-wheel position to said normal, operating position.

51. The rotary fluid pressure device as claimed in claim 18 characterized by said engagement means being a distance A from its rotation-permitting position and said first and second annular grooves and said first and second fluid ports being a distance B from being out of said generally continuous fluid communication, when said valve spool is in said locked position, the distance B being less than the distance A, whereby said continuous communication between said first and second fluid ports ceases before said engagement means becomes disengaged as said valve spool is moved from said locked position to said normal, operating position.

* * * * *